US005265744A

United States Patent [19]

Duty et al.

[11] Patent Number: 5,265,744

[45] Date of Patent: Nov. 30, 1993

[54] TAMPER-PROOF CAP

[76] Inventors: Billy Duty, Rte. 2, Box 201; Ellen McClanahan, Rte. 2, Box 209-A; Randy Newberry, Rte. 2, Box 245-A, all of Grundy, Va. 24614

[21] Appl. No.: 957,098

[22] Filed: Oct. 7, 1992

[51] Int. Cl.[5] ..... B65D 55/02

[52] U.S. Cl. ..... 215/220; 215/203; 215/219; 215/230; 215/250; 206/534; 206/459.1; 206/807; 116/200; 116/279

[58] Field of Search ..... 215/203, 204, 219, 220, 215/230, 250; 206/534, 459.1, 807; 116/200, 279, DIG. 41

[56] References Cited

U.S. PATENT DOCUMENTS

| | | | |
|---|---|---|---|
| 3,472,411 | 10/1969 | Turner | 215/220 |
| 4,069,935 | 1/1978 | Hampel | 215/203 |
| 4,440,306 | 4/1984 | Van Buskirk et al | 215/230 |
| 4,502,605 | 3/1985 | Wloszczyna | 215/230 |
| 4,519,515 | 5/1985 | Schonberger | 215/230 |
| 4,801,028 | 1/1989 | Puresevic et al. | 215/220 |
| 4,984,700 | 1/1991 | Knickerbocker | 215/251 |
| 4,986,429 | 1/1991 | Singleton, Jr. | 215/230 |
| 5,092,477 | 3/1992 | Johnson, Jr. et al. | 215/230 |

*Primary Examiner*—Allan N. Shoap
*Assistant Examiner*—Vanessa Caretto
*Attorney, Agent, or Firm*—S. Michael Bender

[57] ABSTRACT

A tamper-proof cap for containers, bottles and the like comprising a first driven member and a second drive member concentrically mounted on the first member and having a window through which a visible signal may be observed by a viewer. A rupturable capsule containing signal media is supported on the first driven member and displays a signal of first characteristic through the window. Upon opening the cap by causing the drive member to engage the driven member, the capsule ruptures causing the signal media to display a signal of a second characteristic through the window indicative of the fact that an attempt had been made to open the cap. In an alternative embodiment, a lens mounted on the window portion of the drive member enables viewing of the signal characteristic when the containers bearing the caps of the invention are stored on a relatively high shelf.

11 Claims, 5 Drawing Sheets

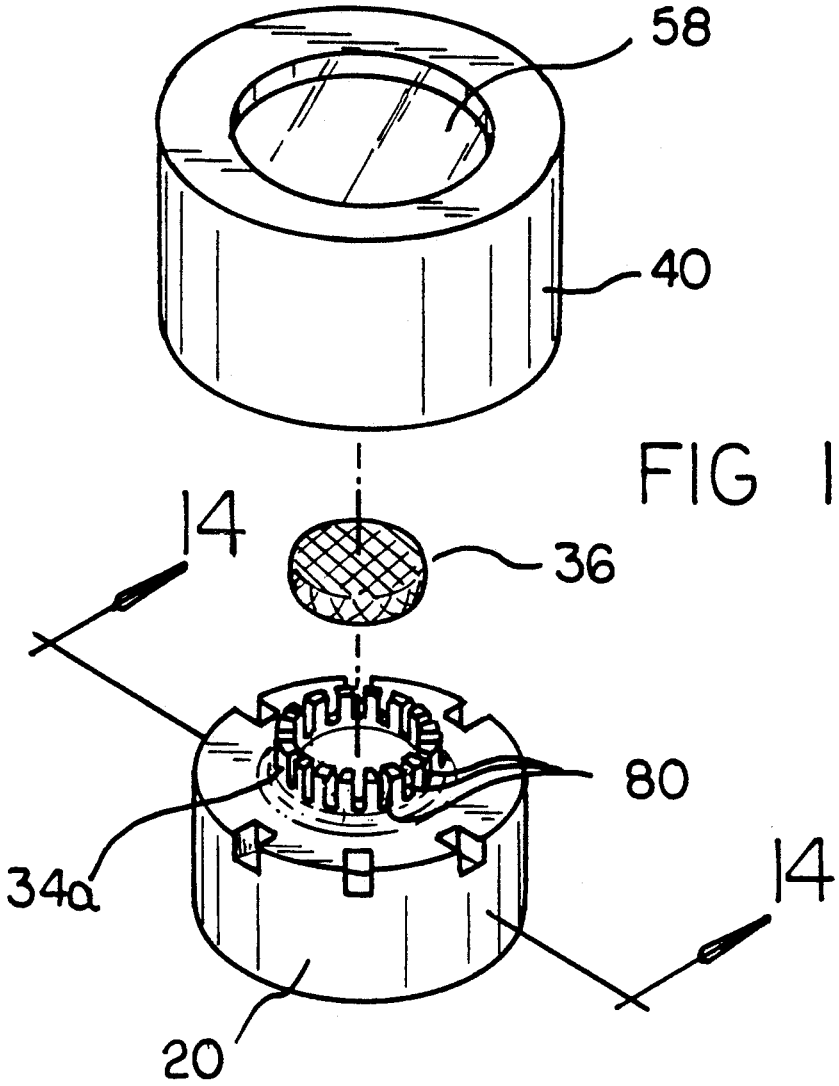
FIG 13
FIG 14
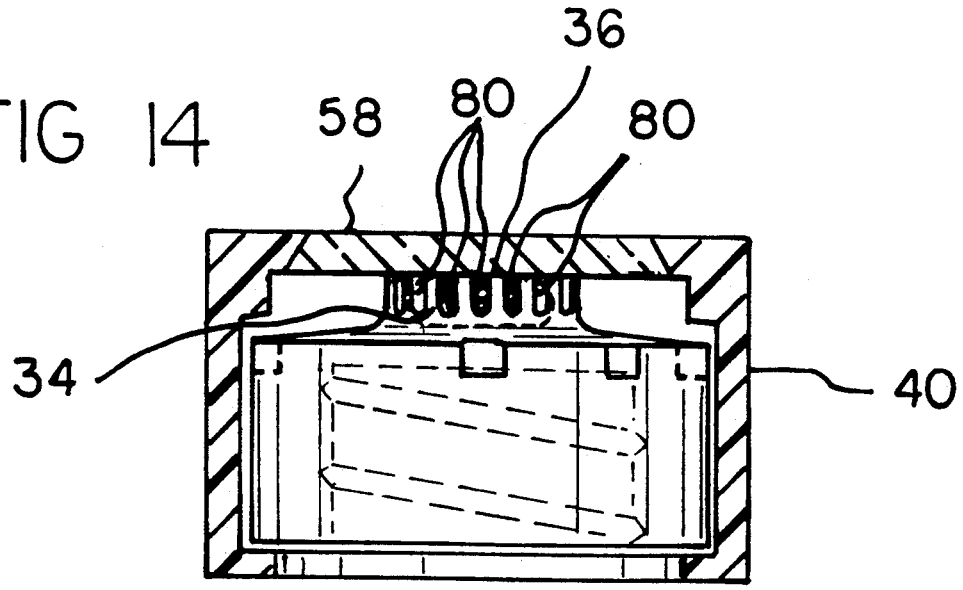

TAMPER-PROOF CAP

BACKGROUND OF THE INVENTION

1. Field of the Invention

The present invention relates generally to tamper-proof caps for containers, bottles and the like, and more particularly, to a tamper-proof cap having a visual indicator that change from a first characteristic to a second characteristic to indicate that the cap has been tampered with.

2. Description of the Prior Art

Tamper-proof closure devices or caps are well known for restricting unauthorized access to the contents of a bottle, container or other enclosure. A typical arrangement consists of a cap or closure which has a portion that is ruptured or "torn away" when the cap is unscrewed and opened for the first time. That fact that a portion of the seal originally formed by the cap has been removed indicates that the container with which the cap is used has been opened thus warning users that the contents might have been compromised. Examples of such tamper-proof or more correctly, "tamper-indicating" cap arrangements are disclosed in the following U.S. Pat. Nos. 4,561,553; 4,638,917; 4,768,666; and 4,899,897.

Another form of well known cap enclosure has means making it difficult to open so that access is limited, especially to small children. Such safety arrangements, referred to herein as "access-limiting" caps, typically require the user to "push down" before the cap enclosure may be unscrewed and removed from the container. This latter form of enclosure cap however, normally does not feature a removable or tearable portion, and thus, does not have means for indicating that the contents of the container might have been tampered with or otherwise compromised.

It is apparent from the foregoing discussion that a clear need exits for an access-limiting cap or closure for bottles, containers, or the like which additionally includes means to indicate that the cap has been opened prior to use of the contents thereof. This requirement for a cap that is both "access-limiting" and "tamper-indicative" is met by the present invention as will be made evident from the following description thereof. Other advantages of the present invention over the prior art also will be rendered apparent.

SUMMARY OF THE INVENTION

To achieve the foregoing and other advantages, the present invention, briefly described, provides a tamper-proof cap for containers, bottles and the like comprising a first driven member and a second drive member concentrically mounted on the first member and having a window through which a visible signal may be observed by a viewer. A rupturable capsule containing signal media is supported on the first driven member and displays a signal of first characteristic through the window. Upon opening the cap by causing the drive member to engage the driven member, the capsule ruptures causing the signal media to display a signal of a second characteristic through the window indicative of the fact that an attempt had been made to open the cap. In an alternative embodiment, a lens mounted on the window portion of the drive member enables viewing of the signal characteristic when the containers bearing the caps of the invention are stored on a relatively high shelf.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least three preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved tamper-proof cap which has all of the advantages of the prior art and none of the disadvantages.

It is another object of the present invention to provide a new an improved tamper-proof cap that can be easily and efficiently manufactured and marketed.

It is a further objective of the present invention to provide a new and improved tamper-proof cap of inexpensive and reliable construction.

An even further object of the present invention is to provide a new and improved tamper-proof cap which is susceptible of a low cost of manufacture with regard to both materials and labor, and which accordingly is then susceptible of low prices of sale to the consuming public, thereby making such tamper-proof cap available to the buying public.

Still yet a further object of the present invention is to provide a new and improved tamper-proof cap that is both access limiting and tamper indicative.

Yet still a further object of the present invention is to provide a new and improved tamper-proof cap having visual indicator means which changes from a first characteristic to a second characteristic upon an initial opening thereof.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 13 is an exploded perspective view of an yet another alternatively preferred embodiment of the invention showing a rupturable retaining member.

FIG. 14 is a cross-sectional view taken along line 14—14 of FIG. 13.

DESCRIPTION OF THE PREFERRED EMBODIMENT

With reference now to the drawings, a new and improved tamper-proof cap or closure embodying the principles and concepts of the present invention will be described.

Figure 1:
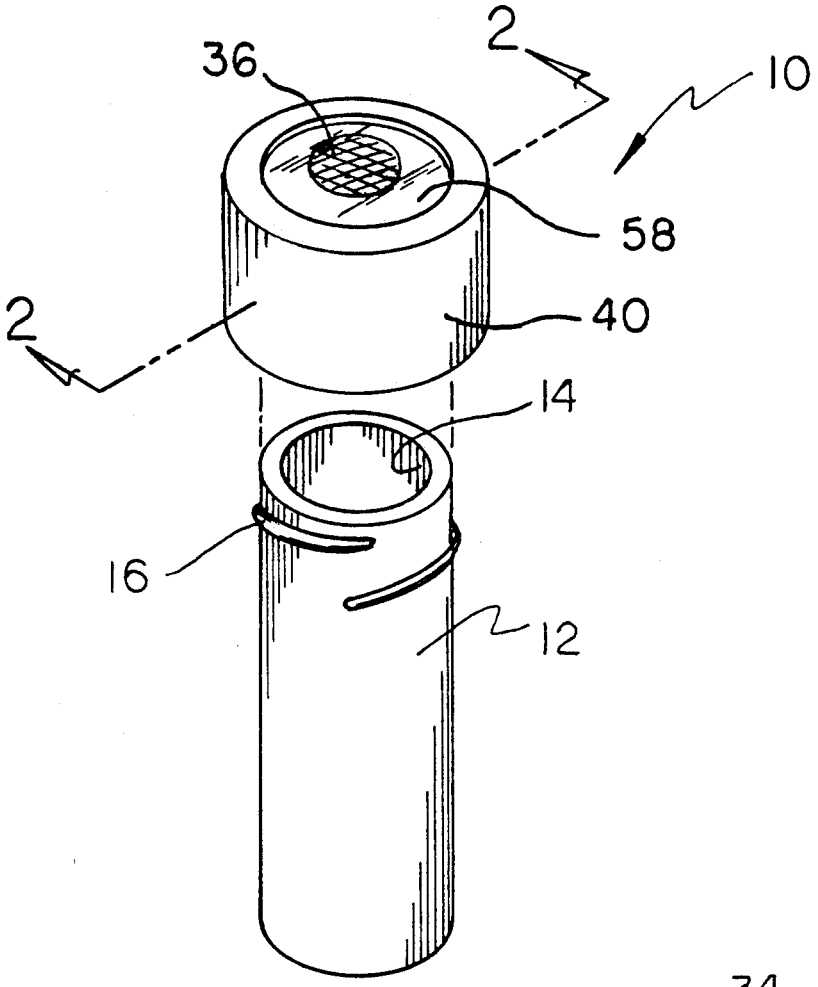
FIG. 1 is a perspective exploded view showing the first preferred embodiment of the tamper-proof cap of the invention with an associated container.

Turning initially to FIGS. 1-7, there is shown a first exemplary embodiment of the taper-proof cap of the invention generally designated by reference numeral 10 associated with a container 12 for which the cap serves as a removable seal or closure. In this regard, and as best seen in FIG. 1, container 12 is of generally cylindrical shape and has an opening 14 at one end thereof and a spiral male thread 16 substantially as shown proximal to the opening and adapted to cooperatively engage a complimentary female thread on the cap 10 as will be subsequently explained.

It will be appreciated that the particular configuration of the container 12 used with cap 10 is outside the scope of the invention and that containers, bottles, or other enclosures of widely differing shape may be employed with the unique cap or closure 10 of invention so long as the container includes a cylindrical opening and thread arrangement substantially as depicted in FIG. 1. For example, the cap 10 may advantageously be used with the familiar aspirin bottle having a cylindrical necked portion terminating in the threaded opening described above with the shape of container 12 as illustrated in FIG. 1 merely being representative to facilitate an understanding of the invention.

Figure 2:
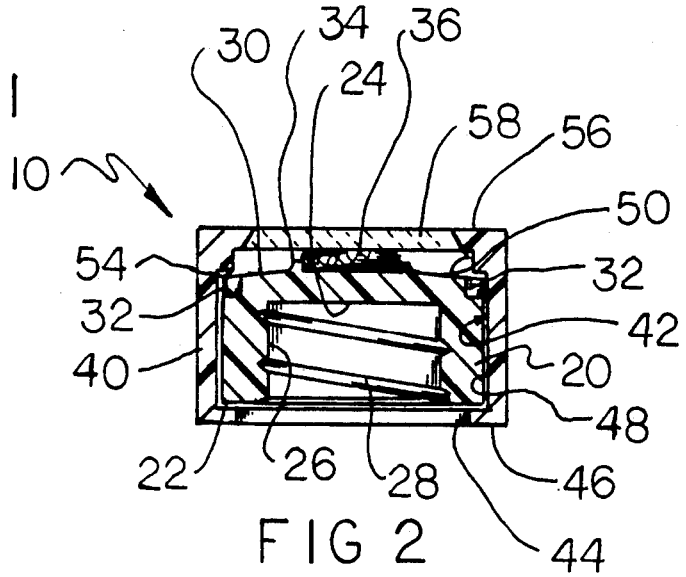
FIG. 2 is a cross-sectional elevational view of the tamper-proof cap along line 2—2 of FIG. 1.
Figure 3:
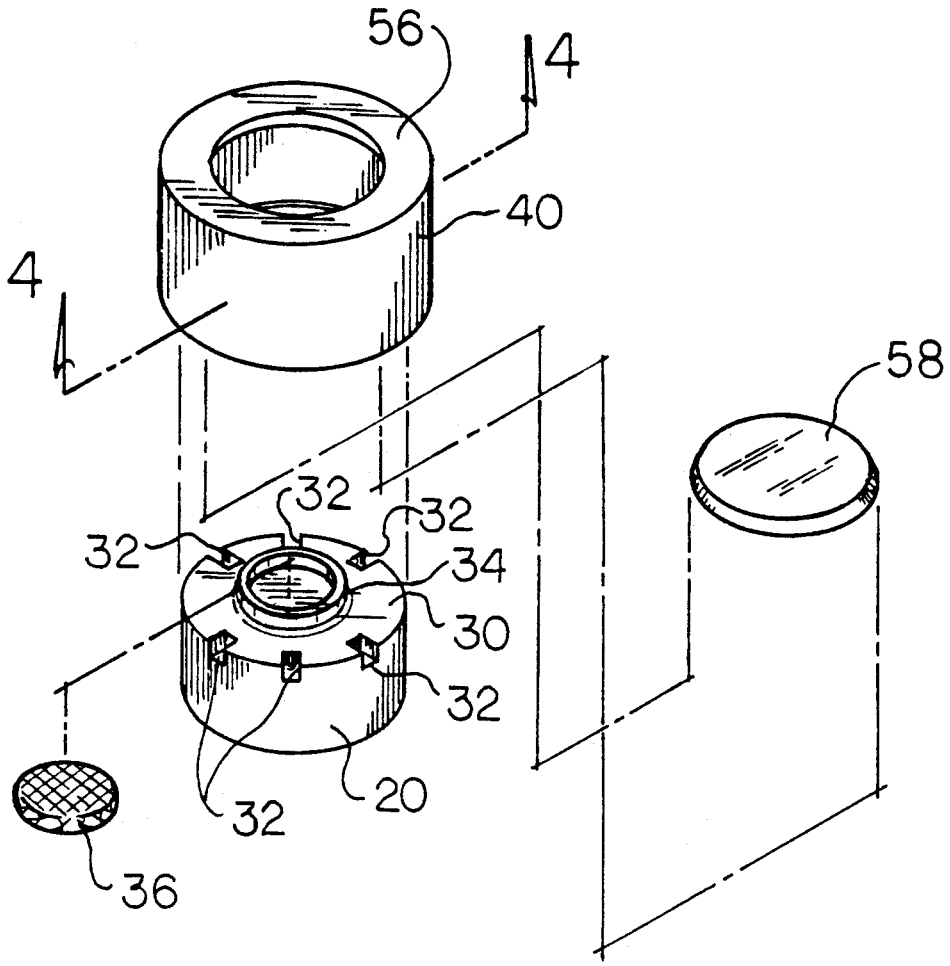
FIG. 3 is a perspective exploded assembly view of the first preferred embodiment of the tamper-proof cap of the invention.
Figure 4:
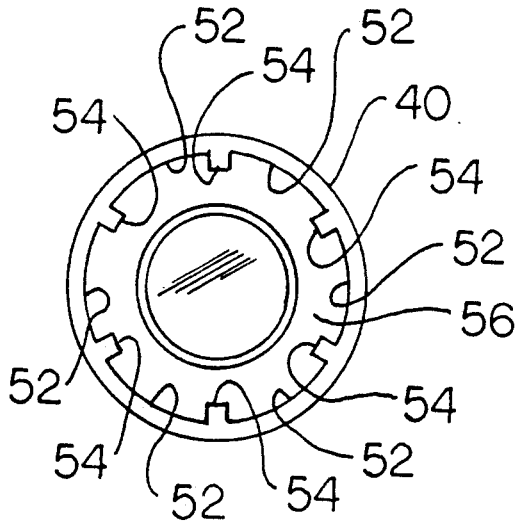
FIG. 4 is a bottom plan view of the drive member portion of the first preferred embodiment of the invention.

Turning to FIG. 2, cap 10 is generally cylindrically shaped and has an inner cylindrically shaped driven member 20 whose bottom surface 22 has a central cylindrically shaped recess 24 sized to fit over and about the distal extremity of container 12 in a sealing relationship with opening 14 therein. Disposed on the inside wall surface 26 defined by cylindrical recess 24 is a spiral female thread 28 complimentary to the male thread 16 of container 12. Hence, as should now be apparent, driven member 20 may be placed on the open end or distal extremity of container 12 and suitably rotated in a first direction relative thereto to cause engagement of threads 16, 28 and sealing locking engagement of the driven member with open end of the container.

Figure 7:
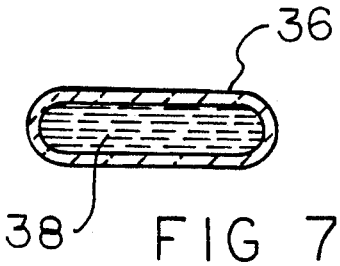
FIG. 7 is a cross-sectional view taken along line 7—7 of FIG. 6.

Driven member 20 further includes an upper cylindrical surface 30 having in its peripheral edge a series of rectangular, substantially evenly spaced notches or keyways each designated by reference numeral 32 (FIGS. 1 and 2). Surface 30 furthermore is slightly crowned toward its center (FIG. 1) and has thereon a central ring 34 serving as an annular member or retaining wall for a visual indicator element which in its preferred form comprises a substantially cylindrically shaped, transparent capsule 36 containing a colored liquid dye 38 (FIG. 7). In accordance with the invention, capsule 36 is fabricated of a suitable thin, membranous material that is readily rupturable when exposed to a relatively light force. A suitable material, for example, comprises the gelatinous material used to make digestible cold remedy capsules which material is mostly preferred. It will be realized however, that in practicing the invention, other thin, transparent, rupturable materials may be used instead such as a wide range of available polymeric materials.

As best seen in FIG. 2, capsule 36 containing liquid dye 38 normally reposes within ring 34 centrally of the upper surface 30 of the driven member 20 and thus, when viewed from above is clearly visible as a sharply distinguished circle or "bull's-eye". In the preferred embodiment, dye 38 has a rich dark color such as "navy blue" or "black" whereas the surrounding surface 30 is given a light, sharply contrasting color such as "white" or "cream" to enhance visibility of the capsule 36 even more.

A cylindrically shaped drive member 40 is loosely fitted concentrically on driven member 20 and is free to rotate relative to the driven member in the position shown in FIG. 2. The drive member 40 has a central cylindrical recess generally designated by reference numeral 42 having three sections of different inside diameter, the first section of which 44 opens into bottom surface 46 of the driven member. The diameter of first section 44 is slightly less than the outside diameter of driven member 20 in order to define a radial circumferential flange or lip for maintaining the drive member 40 rotatably engaged with the driven member 20. Second section 48 of recess 42 is slightly larger than the outside diameter of the driven member whereas third section 50 is slightly smaller than the outside diameter of the driven member and includes a multiplicity of evenly spaced arcuate notches each designated by reference numeral 52 to define a multiplicity of rectangular protrusions or "keys" 54 circumferentially evenly spaced with respect to each other in the third section 50 of recess 42. See FIGS. 2 and 4.

In accordance with the invention, the keys 54 are sized to fit within and engage the notches or "keyways" 32 of the driven member 20 and preferably, the same number of keys 54 as there are keyways 32 are provided. In addition, the angular spacing of both the keys 54 and the keyways 32 is substantially the same relative to the imaginary common central axis of the driven member and the drive member. By this construction and according to the invention, the drive member may be pushed down toward the driven member as viewed in FIG. 2 and simultaneously rotated to cause the keys 54 to enter and engage the keyways 32 all of the while causing rupture of capsule 36 as will be more fully explained below.

Recess 42 defines a relatively thin top wall 56 in which is suitably fixedly secured a cylindrical transparent lens 58 thus forming a window in the top of the drive member through which the colored liquid dye in capsule 36 is clearly visible to an observer substantially as shown in FIG. 1.

In operation, the novel cap or closure 10 of the invention is suitably installed in closing sealing relation with container 12 at the factory or other facility where the packaging of the contents of the container takes place. Preferably, driven member 20 is first installed on the container by rotating the two parts in a first direction until suitable tight sealing engagement is achieved between threads 16 and 28. Capsule 36 then is placed in ring or annulus 34 on surface 30 of driven member 20 and the drive member next is fitted about the driven member to assume the relative position substantially as shown in FIG. 2 where lens 58 rests lightly on capsule 36 and bottom edges of the keys 54 rest on the upper surface of the driven member. This is the initial, unopened condition of container 12 and will be indicated clearly by the visual appearance of the bull's-eye formed by the colored dye in the unruptured capsule substantially as depicted in FIG. 1. In this regard, it will be noted that the parts of the cap 10 preferably are fabricated of a molded polymeric material. Hence, in installing the drive member over the driven member, the side wall of the drive member may be flexed slightly to permit it to be fitted over the driven member without disturbing the integrity of the rupturable capsule 36.

For purposes of the present disclosure, the initial, unopened condition of container 12 thus is represented by a first visual characteristic (i.e. the bull's-eye) conveyed to an observer through the window atop the tamper-proof cap or closure of the present invention. A consumer purchasing or using the container 12 with the first visual characteristic displayed through the window atop the cap 10 (FIG. 1) accordingly will be assured that the cap has not been opened or tampered with after being initially packaged at the factory.

To initially open container 12 and remove cap 10 for the first time after purchase thereof, the user presses down on the outside top surface of the cap's drive member and simultaneously rotates the cap in the direction of an arrow (not show) embossed or otherwise inscribed on the top surface of the cap. It will be noted that the rotational direction required to open the container by removing the closure 10 (i.e. the second direction) is opposite to the first direction used to sealingly engage the closure on the container. This action of pressing down and rotating the drive member in the second direction causes two events to occur substantially simultaneously. First, the capsule 36 is ruptured by the force of the underside of window 58 engaging the capsule constrained in ring 34. Second, the keys 54 on the drive member engage the keyways 32 on the driven member thereby transferring a rotational force from the drive member to the driven member sufficient to disengage threads 16 and 28 and rotate the driven member such that the container cap 10 may be removed from the container.

Figure 5:
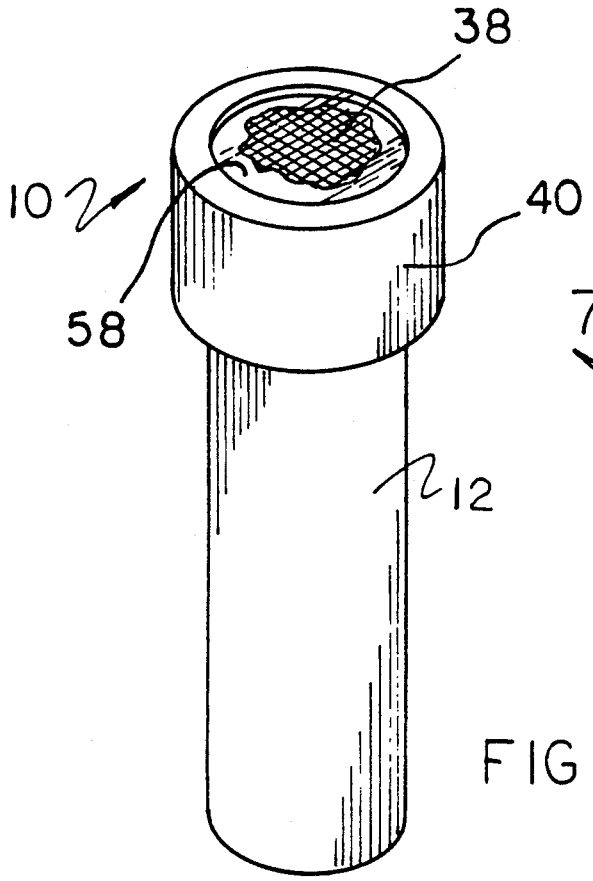
FIG. 5 is a perspective view showing the first preferred embodiment of the tamper-proof cap of the invention with an associated container after an initial attempt to remove the cap thereof.
Figure 6:
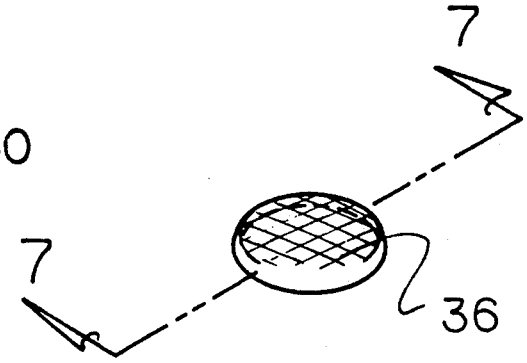
FIG. 6 is a perspective view of the rupturable capsule of the first embodiment of the invention.

In accordance with the invention, and as a result of rupturing capsule 36 during the initial opening process as described above, the liquid dye 38 spreads unevenly across surface 30 of the driven member to form a distinctive scalloped "blob-like" or "ink blot" appearance clearly visible through window 58 atop cap 10 substantially as shown in FIG. 5. For purposes of the present disclosure, the initial, opened condition of container 12 thus is represented by a second visual characteristic (i.e. the scalloped blob or ink blot) conveyed to an observer through the window atop the tamper-proof cap or closure of the present invention. Hence, a consumer purchasing or using the container 12 with the second visual characteristic displayed through the window atop the cap 10 (FIG. 5) accordingly will be warned that the cap had been opened or tampered with after being initially packaged at the factory.

Figure 8:
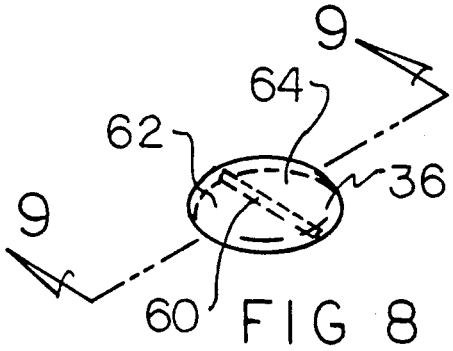
FIG. 8 is a perspective view of an alternatively preferred form of the rupturable capsule of the invention.
Figure 9:
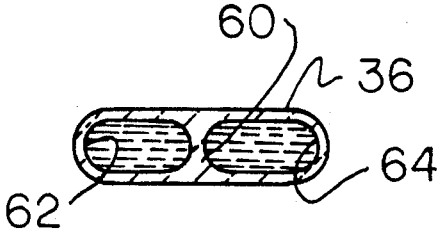
FIG. 9 is a cross-sectional view taken along line 9—9 of FIG. 8.

Turning to FIGS. 8 and 9, there is shown an alternatively preferred embodiment of the invention wherein like parts are represented by like reference numerals. In this version of the best mode of carrying out the invention, capsule 36 has a partition 60 dividing the capsule into two separate compartments 62, 64 each of which contains liquid dye of a different color respectively. In the preferred arrangement, compartment 62 has green dye, whereas compartment 64 contains a yellow dye. The first visual characteristic visible through window 58 thus comprises a split bull's-eye of the two colors. When the cap is opened, and capsule 36 ruptured, the differently colored dyes will mix forming a second visual characteristic of a third color, i.e. yellow-green. This alternative arrangement thus provides an even more enhanced tamper indication to a would be consumer.

Figure 10:
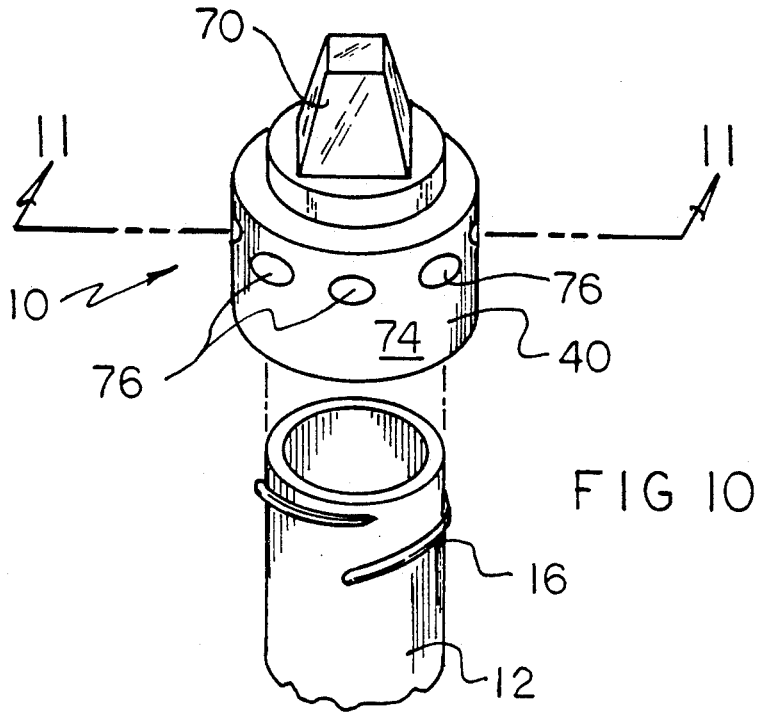
FIG. 10 is a perspective view of an alternatively preferred embodiment of the tamper-proof cap of the invention.
Figure 11:
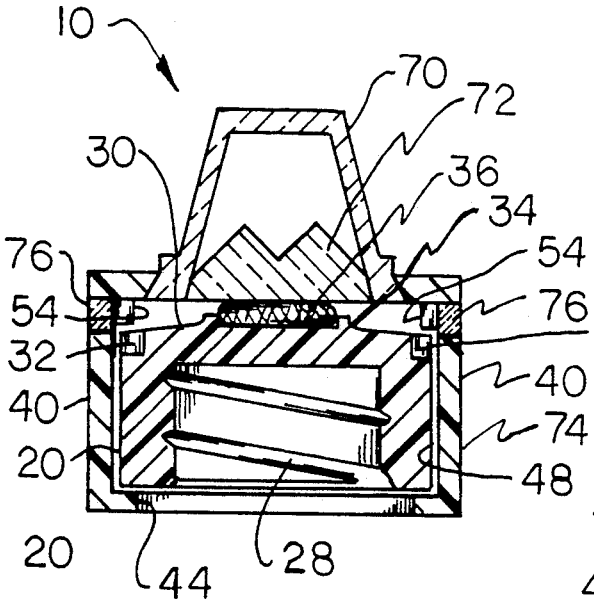
FIG. 11 is a cross-sectional view taken along line 11—11 of FIG. 10.
Figure 12:
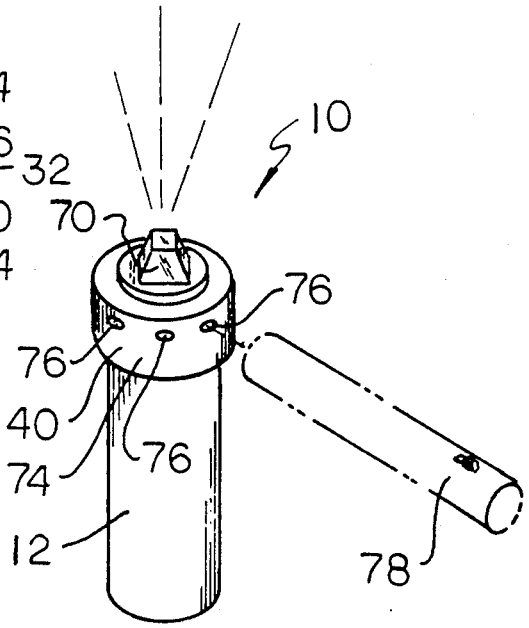
FIG. 12 is a perspective view showing how the alternative embodiment of the invention shown in FIGS. 10 and 11 is employed.

Turning finally to FIGS. 10 through 12, there is shown another alternatively preferred embodiment of the invention wherein again like parts are represented by like reference numerals. In this form of the invention, a raised hollow lens housing 70 having a generally trapezoidal shape substantially as shown is supported atop drive member 40. Lens housing 70 has disposed therein in lieu of lens 58, a light refracting lens element in the form of cube corner optical elements 72. Suitably disposed in sidewall 74 of drive member 40 is an annular array of small lens elements each indicated by reference numeral 76 which latter are evenly spaced about the circumference of cylindrical sidewall 74. Light entering the "side windows" will illuminate the space above surface 30, be refracted by cube corner lens elements 72 and exit the sides of the trapezoidal prism formed by housing 70. As a result of this novel optical arrangement, the visual signal or characteristic presented by cap 10 will be rendered clearly viewable to an observer at eye level, i.e. when the containers 12 are stored on a high shelf thereby facilitating checking of a multiplicity of containers 12 stored on the shelf for tampered articles and without need to remove the containers from the shelf. Moreover, when ambient light levels are low, the condition of the rupturable capsules 36 may be checked by shining a conventional source of light such as produced by a battery-powered searchlight 78 through the side windows 76 as schematically represented in FIG. 12. In this manner, the condition of containers on a store shelf may conveniently be checked at night.

It is apparent from the above that the present invention accomplishes all of the objectives set forth by providing a new and improved tamper-proof cap that is low in cost, relatively simple in design and operation, and which may advantageously be used to indicate if access limited container caps or closures have been tampered with.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. For example as shown in FIGS. 13 and 14, it is within the contemplation of the invention to provide the annular retaining member 34*a* with a series of circumferentially spaced openings or slots 80 so that the retaining member is also rupturable and further to facilitate the flow of the liquid dye beneath the window 58 through the slots. In such case the height of the retaining wall or member may be made greater than that shown in FIGS. 2 and 11 the drawings, and, in fact, engage the underside of the window or lens 58. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved tamper-proof cap for the opening of a container comprising:

a first driven member, said first driven member including means for sealingly engaging said opening of said container upon rotation of said driven member in a first direction and for removing said first driven member from said opening of said container upon rotation in a second direction, a second drive member concentrically mounted for rotation on the first member, said second drive member having a window through which a visible signal may be observed by a viewer, a rupturable capsule containing signal media and being supported on said first driven member for displaying a signal of first characteristic through said window, and engagement means for causing rotation of said first driven member in said second direction upon rotation of said second drive member, said engagement means being effective to cause rupture of said capsule thereby to change said signal media to a second characteristic displayable through said window whereby upon removal of said first driven member from said opening by rotation in said second direction said capsule ruptures causing the signal media to assume a second characteristic displayable through said window.

2. The new and improved tamper-proof closure of claim 1 wherein said engagement means comprises at least one key on said second drive member and at least one keyway on said first driven member, said key being adapted to engage said keyway upon rotation of said second drive member in said second direction to cause rotation of said first driven member in said second direction and substantially simultaneously to cause rupture of said capsule.

3. The new and improved tamper-proof closure of claim 2 wherein said rupturable capsule contains a liquid dye.

4. The new and improved tamper-proof closure of claim 3 wherein said rupturable capsule comprises at least two compartments and contains liquid dye of a different color in each of said compartments respectively.

5. The new and improved tamper-proof closure of claim 2 wherein said rupturable capsule is supported on a surface of said driven member underlying said window on said drive member whereupon said window engages said capsule and causes rupture thereof when said drive member is rotated in said second direction.

6. The new and improved tamper-proof closure of claim 5 wherein said rupturable capsule is supported in an annular member on said surface of said driven member, said annular member being concentric with respect to said window.

7. The new and improved tamper-proof closure of claim 3 wherein said rupturable capsule is substantially cylindrical in shape.

8. The new and improved tamper-proof closure of claim 7 wherein said said signal of first characteristic resembles a bull's-eye and said signal of second characteristic resembles a scalloped blob or an ink blot.

9. The new and improved tamper-proof closure of claim 8 wherein said window comprises an optical lens for facilitating viewing of said signal when said closure is viewed by an observer at eye level.

10. The new and improved tamper-proof closure of claim 6 wherein said annular member is also rupturable and supports said second drive member and prevents activation of said engagement means unless and until a force is exerted by applying pressure against said drive member tending to urge said drive member toward said driven member.

11. The new and improved tamper-proof closure of claim 10 wherein said annular member comprises circumferentially spaced slots thereby rendering said annular member rupturable.

* * * * *